US007454804B2

(12) United States Patent
Macari et al.

(10) Patent No.: US 7,454,804 B2
(45) Date of Patent: Nov. 25, 2008

(54) BED GUARD ASSEMBLY

(75) Inventors: Jason Macari, North Smithfield, RI (US); Steve Gibree, Foster, RI (US)

(73) Assignee: Summer Infant Inc., North Smithfield, RI (US)

( * ) Notice: Subject to any disclaimer, the term of this patent is extended or adjusted under 35 U.S.C. 154(b) by 454 days.

(21) Appl. No.: 11/261,946

(22) Filed: Oct. 28, 2005

(65) Prior Publication Data

US 2006/0130233 A1 Jun. 22, 2006

Related U.S. Application Data

(63) Continuation-in-part of application No. 10/755,704, filed on Jan. 12, 2004, now Pat. No. 6,959,463, which is a continuation-in-part of application No. 10/285,331, filed on Oct. 31, 2002, now Pat. No. 6,725,476.

(60) Provisional application No. 60/623,752, filed on Oct. 29, 2004, provisional application No. 60/411,307, filed on Sep. 17, 2002.

(51) Int. Cl.
*A47C 21/08* (2006.01)

(52) U.S. Cl. ..... 5/426; 5/428; 5/430

(58) Field of Classification Search ..... 5/425, 5/426, 428, 430, 659, 662, 193
See application file for complete search history.

(56) References Cited

U.S. PATENT DOCUMENTS

| | | | |
|---|---|---|---|
| 2,649,594 | A | 8/1953 | Harz et al. |
| 2,667,647 | A | 2/1954 | Reggiani |
| 2,722,693 | A | 11/1955 | Wolf |
| 2,751,608 | A | 6/1956 | Lucas |
| 3,289,223 | A | 12/1966 | Oja et al. |
| 3,290,701 | A | 12/1966 | Luff |
| 3,474,473 | A | 10/1969 | Hannaberg |
| 4,178,645 | A | 12/1979 | Cosme |
| 4,833,743 | A | 5/1989 | Howell et al. |
| 5,038,430 | A | 8/1991 | Bly |
| 5,437,067 | A | 8/1995 | Bernstein et al. |
| 5,463,784 | A | 11/1995 | Alpern |
| 5,519,905 | A | 5/1996 | Bernstein et al. |
| 5,577,277 | A | 11/1996 | Sundberg et al. |
| 5,596,776 | A | 1/1997 | Huang |
| 5,640,726 | A | 6/1997 | Fichner-Rathus |
| 6,134,731 | A | 10/2000 | Thom et al. |
| 6,453,490 | B1 | 9/2002 | Cardinale |
| 6,725,476 | B2 | 4/2004 | Macari |

(Continued)

FOREIGN PATENT DOCUMENTS

| | | | |
|---|---|---|---|
| GB | 2070921 | A | 9/1981 |

(Continued)

*Primary Examiner*—Michael Trettel
(74) *Attorney, Agent, or Firm*—IP Strategies

(57) ABSTRACT

A bed guard assembly includes a one or more end panels, a spanner, connectors and an extension. The spanner is placed against the top or bottom surface a mattress. The connectors connect the spanner to the end panels such that one end panel opposes another end panel across the mattress when the spanner is disposed against the surface of the mattress. The extension is removably attached to one of the connectors and extends from the connector at a substantially right angle with respect to the spanner.

84 Claims, 9 Drawing Sheets

U.S. PATENT DOCUMENTS 6,728,981 B1 5/2004 Gutierrez
6,952,847 B1 10/2005 Cleary
6,959,463 B2 11/2005 Macari
7,237,285 B2 * 7/2007 Brewin et al. ..... 5/426
2004/0168251 A1 9/2004 Waldman et al.

FOREIGN PATENT DOCUMENTS

GB 2225716 A 6/1990

* cited by examiner

BED GUARD ASSEMBLY

CROSS-REFERENCE TO RELATED APPLICATIONS

This is based on U.S. Provisional Patent Application Ser. No. 60/623,752, which was filed on Oct. 29, 2004, which is a continuation-in-part of U.S. patent application Ser. No. 10/755,704, which was filed on Jan. 12, 2004, now U.S. Pat. No. 6,959,453, which in turn is a continuation-in-part of U.S. patent application Ser. No. 10/285,331, which was filed on Oct. 31, 2002, now U.S. Pat. No. 6,725,476, and which in turn was based on U.S. Provisional Patent Application Ser. No. 60/411,307, which was filed on Sep. 17, 2002.

BACKGROUND OF THE INVENTION

The present invention relates to guard assemblies for beds, used to prevent an occupant of the bed from falling off the bed.

Bed guard assemblies, such as side rails, are well known. These assemblies are useful in several applications. For example, small children making the transition from sleeping in an enclosed crib to sleeping on an open bed often need a barrier to prevent a fall onto the floor while sleeping. Use of such barriers on the top bunk of a set of bunk beds also prevents a child from inadvertently falling during the night. Often, bed-ridden adults, such as hospital patients, require such a barrier also. Beds on moving platforms, such as trains and ships, often use such restraints, as do beds on submarines and in other environments in which tight quarters require a narrow sleeping space. Conventionally, these rails are placed on the sides of the bed only, but can also be placed at the head and foot of the bed, if the frame and headboard do not provide a sufficient barrier.

Conventional bed guard assemblies provide the obstruction needed for any of these applications, but usually have one or more disadvantages. For example, many systems can be large and bulky, making assembly and disassembly difficult, and storage impractical. These systems are usually disposed under the mattress or attached directly to the bed using means that are similarly complicated and unwieldy. Simpler systems have been devised, but these tend not to be as sturdy or durable. Others provide hard, heavy impediments that could actually hurt a child when bumped, and over time might also damage the bed. What is needed is a secure bed guard that is easy to attach to and detach from the bed, that is compact for storage, and that provides a safe barrier for a child.

BRIEF SUMMARY OF THE INVENTION

The present invention is a bed guard apparatus that attaches to a bed and provides a secure barrier against falling out of the bed. The apparatus includes opposing panels that act as the barriers, and which are connected together, for example, below the mattress. The connection system is adjustable to adapt to any size bed, and provides for quick and easy implementation. When not in use, the apparatus is compact and easy to store.

Thus, according to one aspect of the present invention, a bed guard assembly includes a number (for example, two) of end panels, a spanner, connectors, and an extension. The spanner is placed against the top or bottom surface of a mattress. The connectors connect the spanner to the end panels such that at least one end panel opposes another end panel across the mattress when the spanner is disposed against the surface of the mattress. The extension is removably attached to one of the connectors and extends from the connector at a substantially right angle with respect to the spanner.

The bed guard assembly can include more than one spanner, for example, two spanners. In this case, each end panel can have two associated connectors, and each spanner can be connected to a corresponding opposing connector on each end panel.

The spanner can include flexible connecting material. For example, the flexible connecting material can include strips of webbing. Each of the connectors can include a mechanism for reducing an amount of slack of flexible connecting material disposed between the end panels when the flexible connecting material is disposed against the mattress and the end panels oppose each other across the mattress. For example, the mechanism can include a strap tensioner in communication with the flexible connecting material, and a ratchet device in communication with the strap tensioner. The strap tensioner provides releasable attachment of the mechanism with the flexible connection material. The ratchet device controls travel of the flexible connecting material with respect to the mechanism.

Alternatively, the spanner can be a rigid member, or can include a rigid member.

The extension can extends downward from one of the connectors. Further, the extension can be adapted to engage a side surface of the mattress, a side surface of a box spring on which the mattress is to be disposed, or a frame on which the mattress is to be disposed. Alternatively, the extension can extend upward from one of the connectors, and can engage a side surface of the mattress.

The extension can include an attachment portion and an extension portion. Further, the connector can include a first ratcheted surface, and the attachment portion can include a second ratcheted surface that engages the first ratcheted surface to removably attach the extension to the connector. Engagement of the first and second ratcheted surfaces can be adjusted to secure a distance between the connector and the extension portion of the extension. The attachment portion can be biased such that the first and second ratcheted surfaces engage to hold the extension in place with respect to the connector. Further, the attachment portion can be flexible such that the bias can be overcome so that the extension can be removed from the connector.

A number of extensions can be provided that corresponds in number to a number of the connectors, such that each extension is removably attached to a respective one of the connectors.

The end panels can include a rigid outer frame made from removably connected rigid tubes.

The end panels can include a rigid outer frame including substantially parallel opposing top and bottom portions connected to substantially parallel opposing side portions.

The end panels can include a rigid outer frame including a top portion and first and second side portions, and at least one stabilizer that extends toward another end panel at a substantially right angle to a plane defined by the top portion and the first and second side portions.

The end panels can include a rigid outer frame including a number of segments that are removably attached to each other.

The end panels can include a rigid outer frame and a fabric portion framed by the rigid outer frame.

The connectors can be rigid structures, and each connector can be removably attached to one of the end panels and form a substantially right angle with the end panel.

Each said connector can include a first end connected to the spanner, a second end connected to one of the end panels, and an angled joint between the first and second ends. The first end can be removably attached to the spanner and the second end can be removably attached the end panel.

The end panels can include a rigid outer frame and a substantially horizontal rigid segment spanning an interior of the outer frame. The rigid outer frame can include substantially parallel opposing top and bottom portions connected to substantially parallel opposing side portions. The substantially horizontal rigid segment can be coupled to the substantially parallel opposing side portions. The assembly can also include fasteners that fix a position of the substantially horizontal rigid segment with respect to the substantially parallel opposing side portions. For example, the assembly can include a number of fasteners, selected ones of which fix the substantially horizontal rigid segment at a selected position with respect to the substantially parallel opposing side portions, corresponding to the selected fasteners. The fasteners can be, for example, coupled to the substantially parallel opposing side portions. In this case, the substantially horizontal rigid segment can include apertures that mate with corresponding ones of the fasteners to fix a position of the substantially horizontal rigid segment with respect to the substantially parallel opposing side portions. The substantially horizontal rigid segment can include a tubular horizontal portion having first and second end portions that couple with the substantially parallel opposing side portions. The tubular horizontal portion can include a plurality of slidably attached tubular segments. The first and second end portions can be substantially vertically-oriented tubes that slide over the respective substantially parallel opposing side portions. The assembly can also include fasteners coupled to the substantially parallel opposing side portions. For example, the first and second end portions can include apertures that communicate with the fasteners to fix a position of the substantially horizontal rigid segment with respect to the substantially parallel opposing side portions. The first and second end portions can include a plurality of apertures, including selected ones that communicate with the fasteners to fix the substantially horizontal rigid segment at a position with respect to the substantially parallel opposing side portions corresponding to the selected ones of the plurality of apertures. Alternatively, the assembly can include first fastener portions coupled to the substantially parallel opposing side portions, and second fastener portions, coupled to the substantially horizontal rigid segment, which mate with corresponding ones of the first fastener portions to fix a position of the substantially horizontal rigid segment with respect to the substantially parallel opposing side portions.

According to another aspect of the invention, a bed guard assembly includes an end panel, a spanner, at least one connector, and an extension. The spanner is placed against a top or bottom surface of a mattress. The connector connects the spanner to the end panel at a substantially right angle. The extension is removably attached to the connector and extends from the connector at a substantially right angle with respect to the spanner.

The spanner can include flexible connecting material, and the assembly can also include at least one base element coupled to the flexible connecting material such that the end panel opposes the base element across the mattress when the flexible connecting material is disposed against the mattress. For example, the flexible connecting material can include strips of webbing.

DETAILED DESCRIPTION OF THE INVENTION

Figure 1:
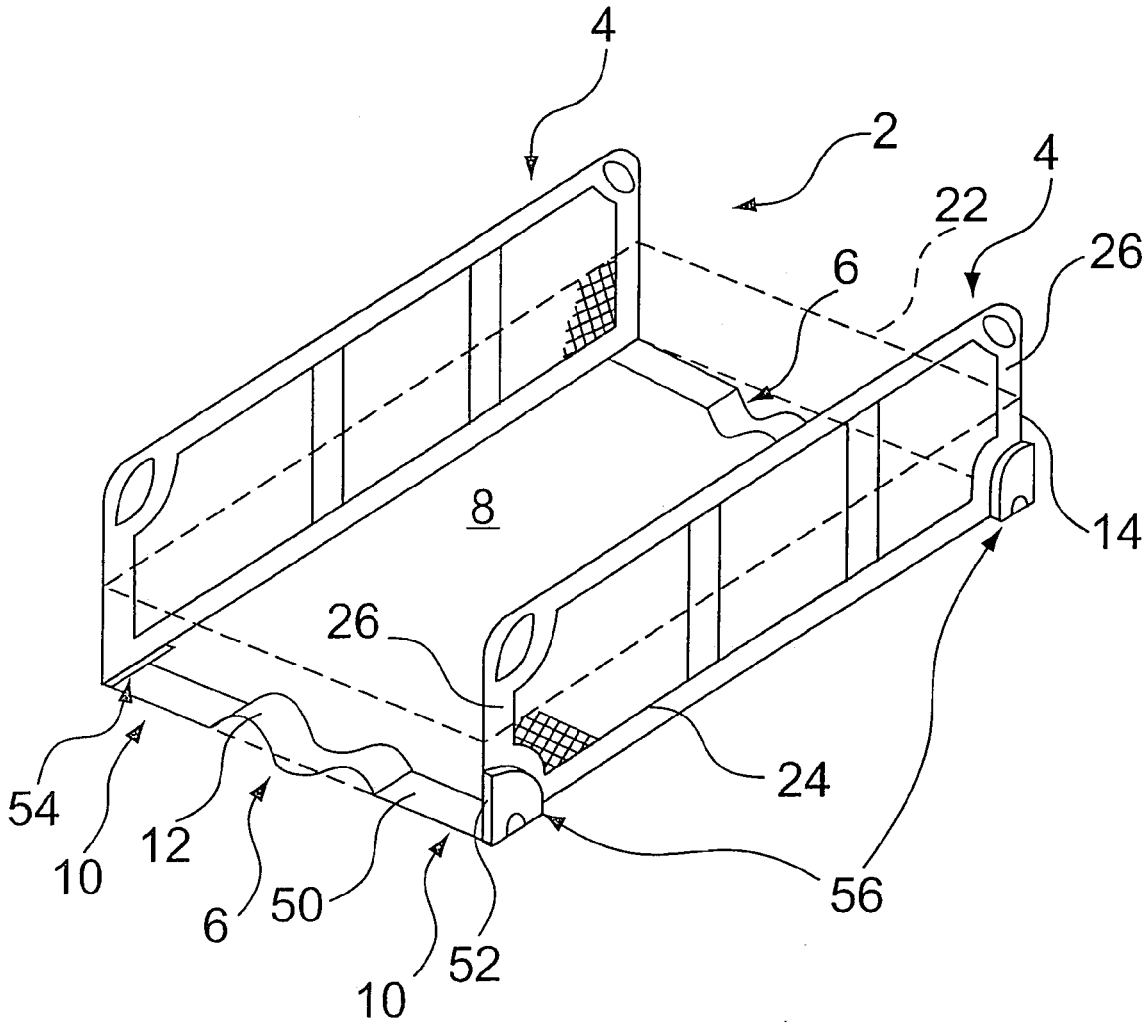
FIG. 1 is a diagram of a first exemplary embodiment of the present invention.

FIG. 1 shows a first exemplary embodiment of the bed guard assembly 2 of the present invention. This embodiment includes two end panels 4, flexible connecting material 6 for placement beneath a mattress 8, and connection pieces 10. As shown, the connection pieces 10 connect the flexible connecting material 6 to the end panels 4 such that at least one end panel opposes another end panel when the flexible connecting material 6 is disposed beneath a mattress 8. The flexible connecting material 6 can rest on a box spring located beneath the mattress 8, directly on the bed fame surface, on slats supporting the mattress 8, or on any other bedding element that might be present in the bedding configuration. Preferably, the end panels 4 extend vertically above the upper surface of the mattress 8.

The flexible connecting material 6 can include strips of webbing 12. As shown in FIG. 1, an exemplary embodiment includes two strips of webbing 12 material, connected to ends of the end panels 4. The strips of webbing 12 can be made of suitable material that is durable and flexible, such as nylon.

Figure 2:
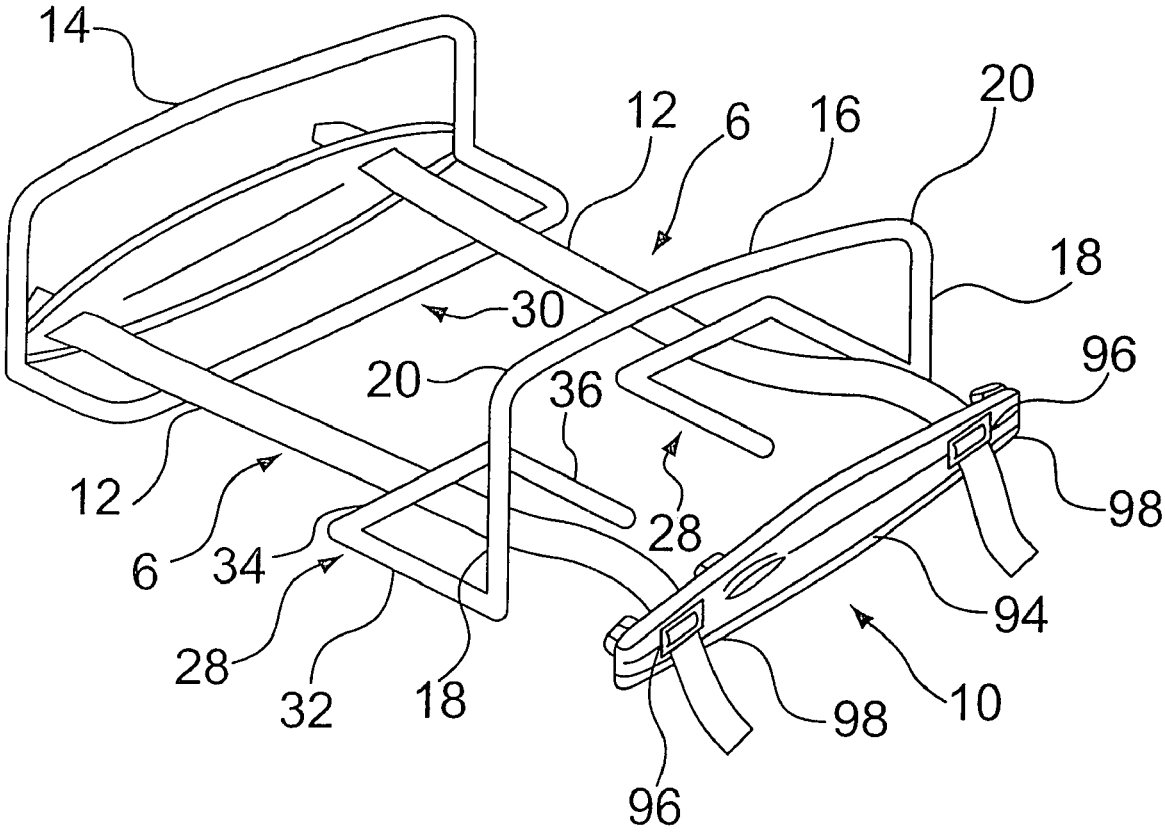
FIG. 2 is a diagram of a second exemplary embodiment of the present invention.

As shown, the exemplary end panels 4 include a rigid outer frame 14. This frame 14 can be made of any rigid, durable material. For example, the frame 14 can be constructed of hard plastic or PVC, or of metal, such as steel or aluminum. As shown in FIG. 2, the rigid outer frame 14 can be made from removably connected rigid tubes. These tubes can have ends with different cross-sectional diameters, so that each rigid tube can be fitted to adjacent rigid tubes by sliding the larger diameter end over a smaller diameter end. These tubes can be friction fitted for attachment, or can be fixed in place through the use of spring buttons or other fasteners.

The rigid outer frame 14 can be constructed as a unitary piece, or from a number of components, such as a top member 16, two side members 18, and two corner members 20 attaching respective side members 18 to opposite ends of the top member 16, as shown in FIG. 1. Alternatively, the rigid outer frame 14 can include substantially parallel opposing top and bottom portions 22, 24 connected to substantially parallel opposing side portions 26, and can have rounded corners at connections of the top piece with the side pieces, as shown in FIG. 1. In any case, the rigid outer frame 14 can include a number of segments 32, 34, 36 that are removably attached to each other, for easy disassembly and storage.

Figure 6:
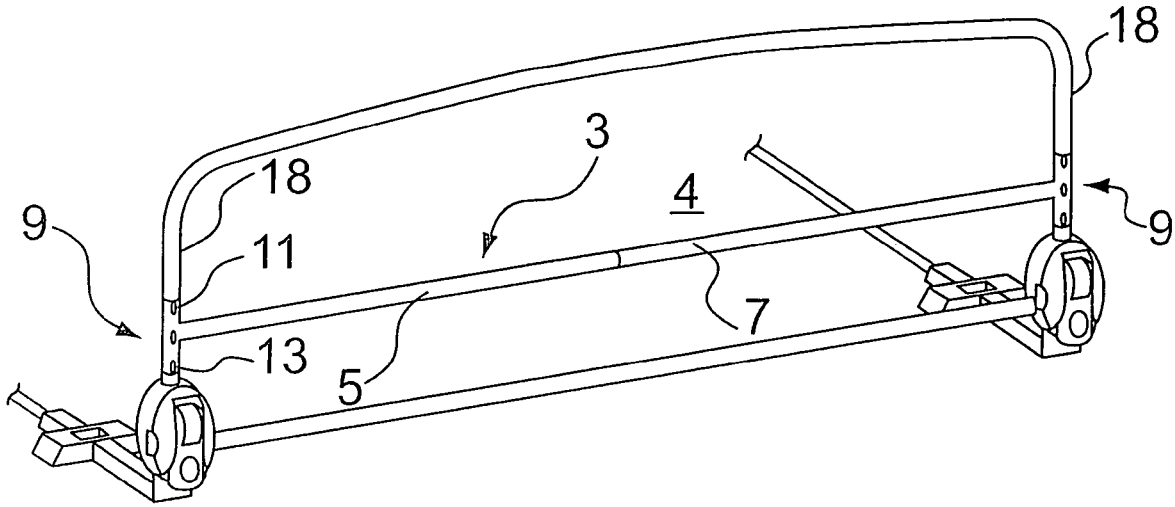
FIG. 6 is a diagram of an outer frame of an end panel having an additional horizontal segment.

As shown in FIG. 6, one or more end panels 4 can also include a horizontal segment 3, which can add stability to the panel, and can provide an added protective barrier. The horizontal segment 3 can be constructed, for example, of two or more slidably attached tubular segments 5, 7. As shown, the horizontal segment 3 can be coupled to the side members 18. In particular embodiments, the horizontal segment 3 will be slidably coupled to the side members 18. For example, the end portions 9 of the horizontal segment 3 can be tubes that slide over the respective side members 18.

Figure 7:
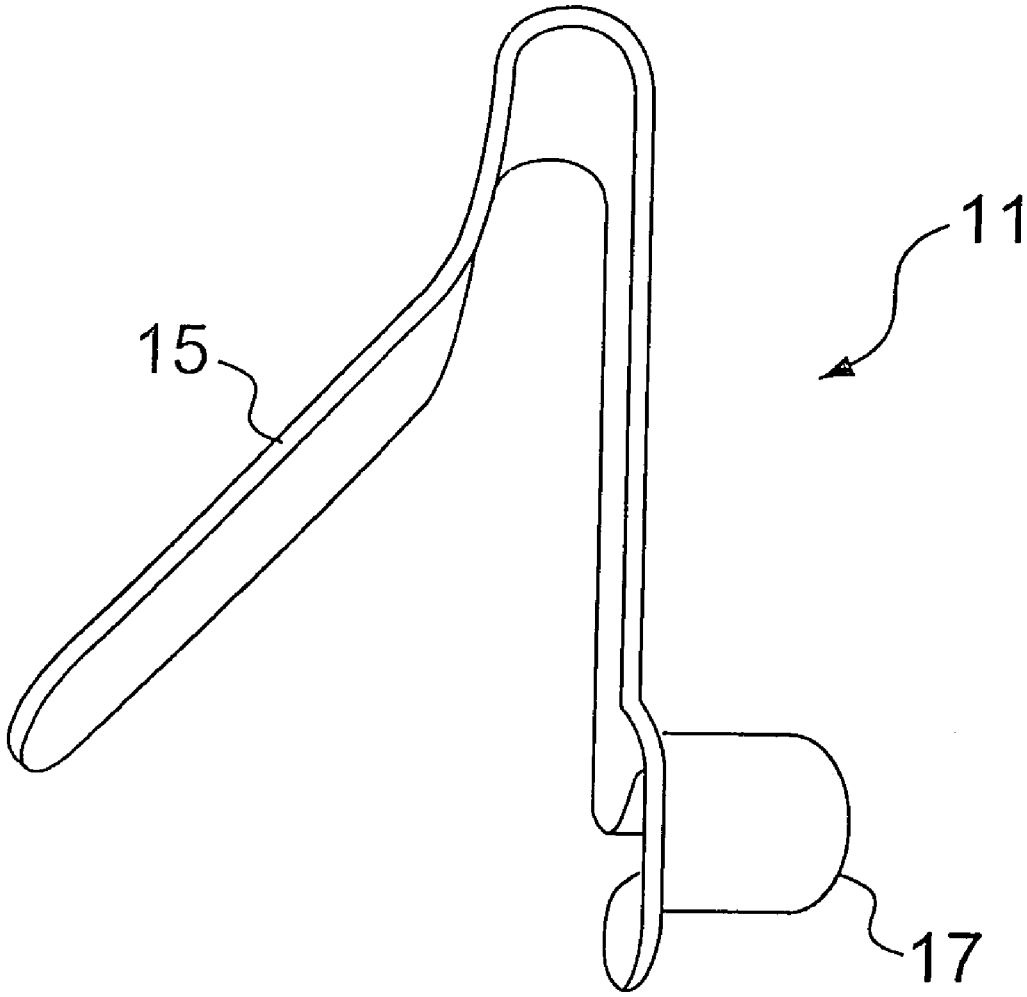
FIG. 7 shows an exemplary fastener.

With reference to FIG. 7, the bed guard assembly 2 can include fasteners 11 that fix the position of the horizontal segment 3 with respect to the side members 18. The height of the horizontal segment 3 can be made adjustable by providing a number of fasteners 11 on the side members 18, and selecting fasteners 11 corresponding to the desired height of the horizontal segment 3 to secure the attachment. These fasteners can be of a mating-pair type, for example, in which a first portion of the fastener is attached to the side members 18, and the second, mating portion is attached to the horizontal segment 3. Alternatively, fasteners on the side members 18 can mate with holes 13 in the ends of the horizontal segment 3 to fix the chosen position.

In a particular preferred embodiment, fasteners 11 are coupled to the insides of the side members 18. The side members 18 can include holes 13 through which the fasteners 11 can mate with holes 13 in the end portions 9 of the horizontal segment 3. If the end portions 9 of the horizontal segment 3 include a number of holes 13, as shown, the height of the horizontal segment 3 can be chosen by selecting the mating holes 13 accordingly. A fastener 11 that can be used advantageously with this embodiment includes a spring portion 15 and a button 17, as shown in FIG. 7. The spring portion 15 provides a bias that pushes the button 17 through the hole 13 in the side members 18 and through the selected hole 13 in the end portions 9 of the horizontal segment 3 to hold the horizontal segment 3 in place. Depressing the button 17 allows the horizontal segment 3 to be moved to a different position, where it can be fixed in place by releasing the button 17. An example of a commercial fastener of this type is a Valco® snap button.

The embodiment shown in FIG. 1 also has at least one extension 28, 30 that extends at a substantially right angle to a plane defined by the top portion 22 and the first and second side portions 26. For example, the frame 14 can include two extensions 28, one each attached to the first and second side portions 26, or a single extension 30 attached to the frame 14 at both side portions 26. Like the rest of the frame 14 shown in FIG. 2, each extension 28, 30 includes a number of connected segments 32, 34, 36. For example, the extensions 28 can each include three segments 32, 34, 36 that can be connected to form three sides of a rectangle, as shown, connected by one of the segments 32, 34, 36 to a side portion of the rigid outer frame 14 to form the extension 28. If there is only one extension 30, a second segment can be connected to the other side portion of the rigid outer frame 14. In any case, the extension(s) 28, 30 provide a base that allows the end panel to stand upright.

Figure 3:
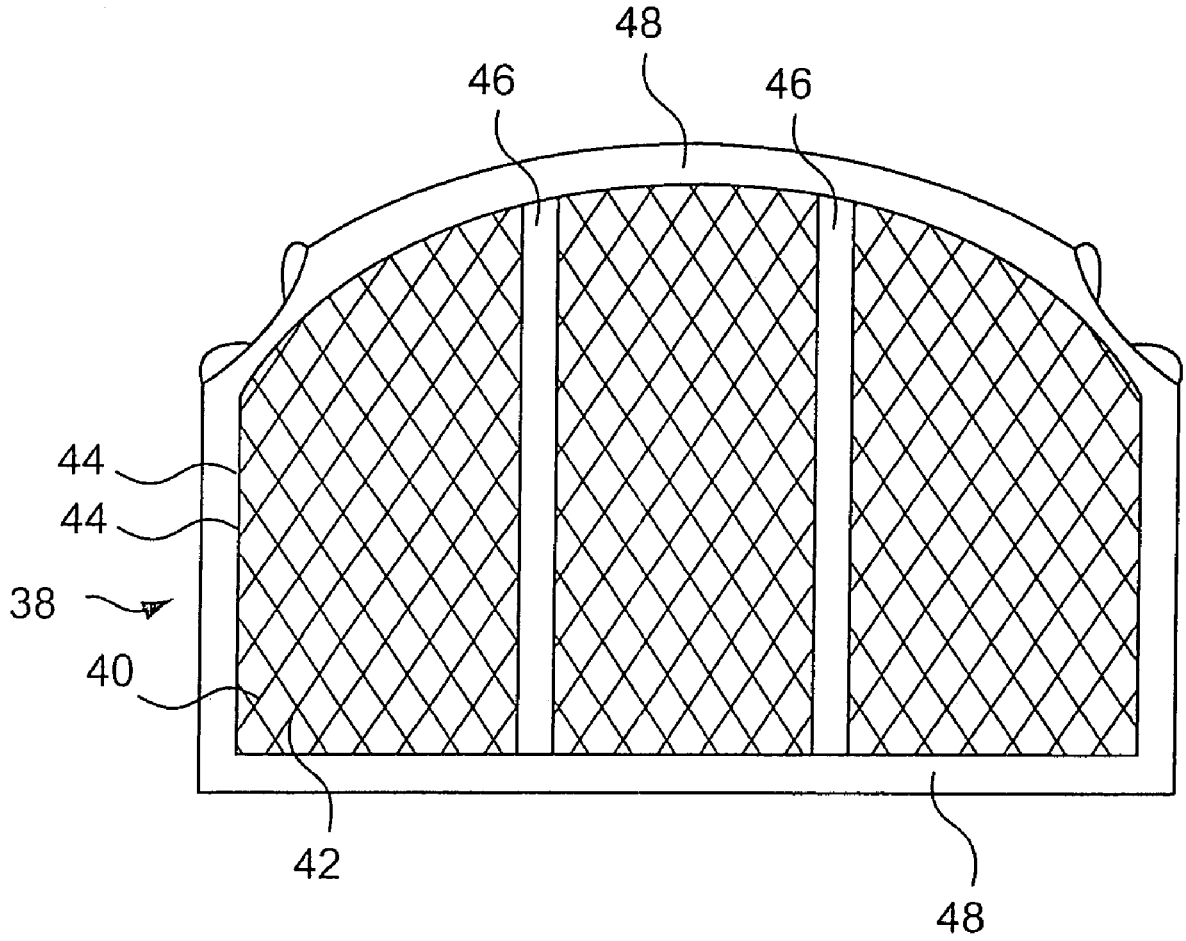
FIG. 3 is a diagram of an exemplary end panel of the present invention.

An exemplary end panel of the present invention is shown in FIG. 3. As shown in FIG. 1, the end panel includes a fabric portion 38 framed by the rigid outer frame 14. The fabric portion 38 can include netting 40, which in turn can be made from a mesh material 42 having openings 44 of any appropriate size, for example, between about 0.25 inches and about 2 inches. The fabric portion 38 can include one or more stabilizing straps 46 spanning the fabric portion 38, to provide more durability over the span of the fabric portion 38. The stabilizing straps 46 can be made of any flexible, strong material, such as nylon.

The fabric portion 38 can also include a border 48, which also can be made of nylon, around its outer periphery, and the stabilizing straps 46 can be attached to the netting 40 and to the nylon border 48, for example, at top and bottom ends of the fabric portion 38 as shown. Alternatively, the stabilizing straps 46 can be attached to the netting 40 and to top and bottom portions 22, 24 of the rigid outer frame 14 itself. The nylon border 48 can include a sleeve that accepts components of the rigid outer frame 14. For example, given the tubular construction of the frame 14 shown in FIG. 2, the individual top and side tubes can be inserted into the border sleeves and connected. Thus, when the frame 14 is complete, the fabric portion 38 is held in place by the border 48.

Another way that the fabric portion 38 can be removably attached to the rigid outer frame 14 is by fitting the fabric portion 38 over the rigid outer frame 14. In this case, the fabric portion 38 can be made from a stretch material that provides a tension fit with the rigid outer frame 14. Alternatively, the fabric portion 38 can be attached to the frame 14 through the use of fasteners, which attach to the frame 14 itself, or which attach to other fasteners on the fabric portion 38 after, for example, wrapping the frame 14. These fasteners can be, for example, snaps, or hook and loop fasteners such as Velcro®.

The connection pieces 10 preferably are rigid structures, constructed to form a substantially right angle 54 with the respective connected end panel The connection pieces 10 can be fixed to the end panels 4 and to the connecting material 6, or they can be removably attached. For example, the connection pieces 10 can be attached to the end panels 4 by a connection mechanism that provides the removable attachment. Alternatively, the connection pieces 10 can be simple articles, such as a rigid footing 50 attached to the connecting material 6.

Alternatively, the connection pieces 10 can be an angled joint 52 connected between the connecting material 6 and the end panels 4, preferably removably attached. The angled joint 52 can be adjustable, and can have a number of fixed stops. For example, the adjustable angled joint 52 can have a stop fixed at a substantially right angle 54, and other stops to fix the relative position at other useful angles. The range of adjustability of the angled joint 52 preferably allows the end that is attached to the connecting material 6 to be folded against the end panel, providing a low profile for storage.

Figure 4:
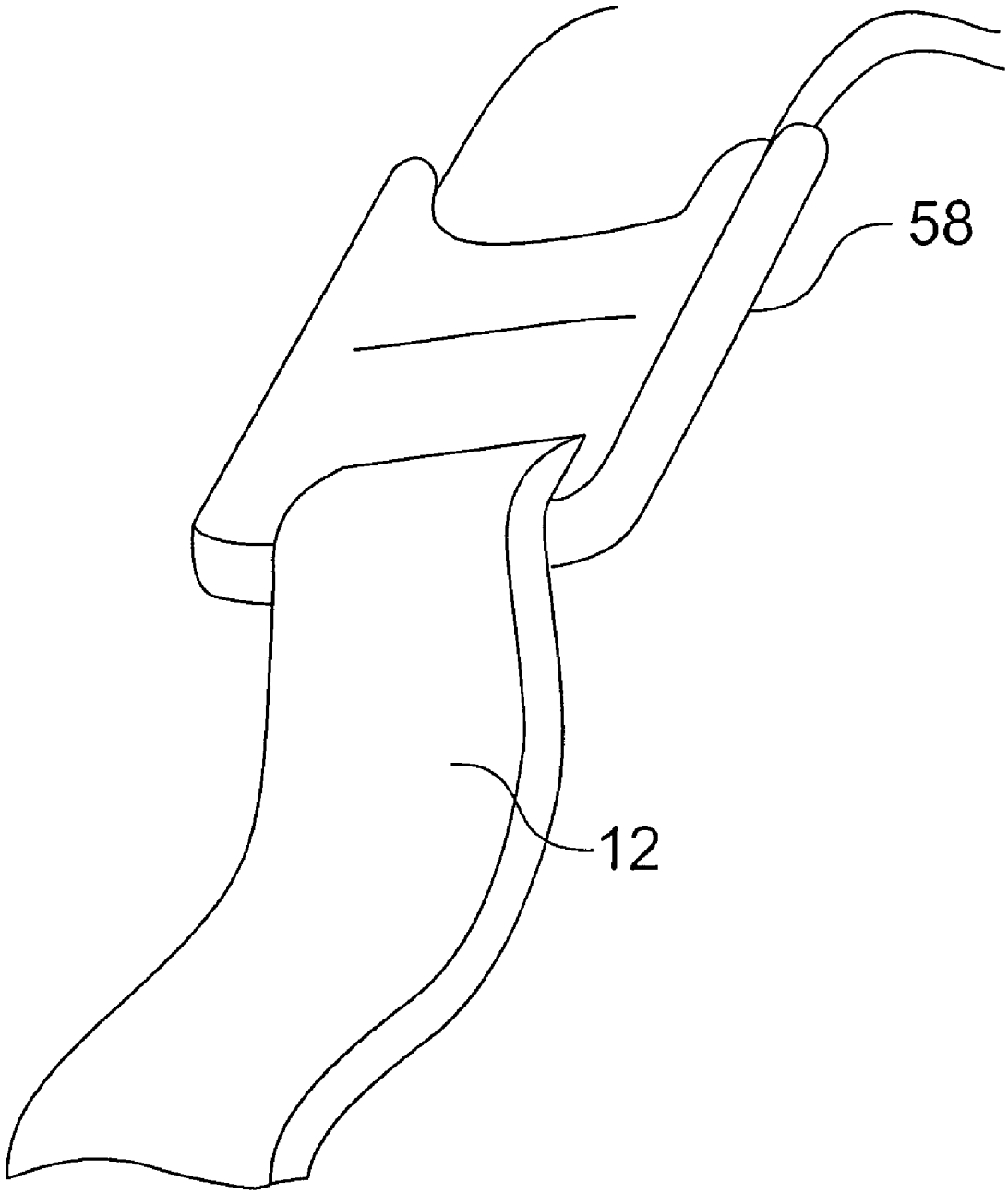
FIG. 4 is a diagram of a first exemplary adjustment mechanism of the present invention.

The connection pieces 10 can also include an adjustment mechanism, such as a mechanism for decreasing the length of connecting material 6 disposed between the end panels 4, or for reducing an amount of slack of connecting material 6 disposed between the end panels 4 when the end panels 4 are disposed in fixed positions or when the connecting material 6 is disposed beneath the mattress 8 and the end panels 4 are placed against opposite sides of the mattress 8. For example, the mechanism 56 can be a buckle 58 or similar device that is well known to those of skill in the art. An example of such a buckle 58 is shown in FIG. 4.

Figure 5A:
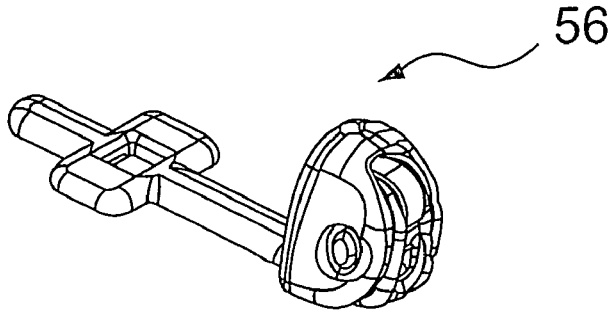
FIG. 5A is a diagram of a second exemplary ratcheting adjustment mechanism of the present invention.
Figure 5B:
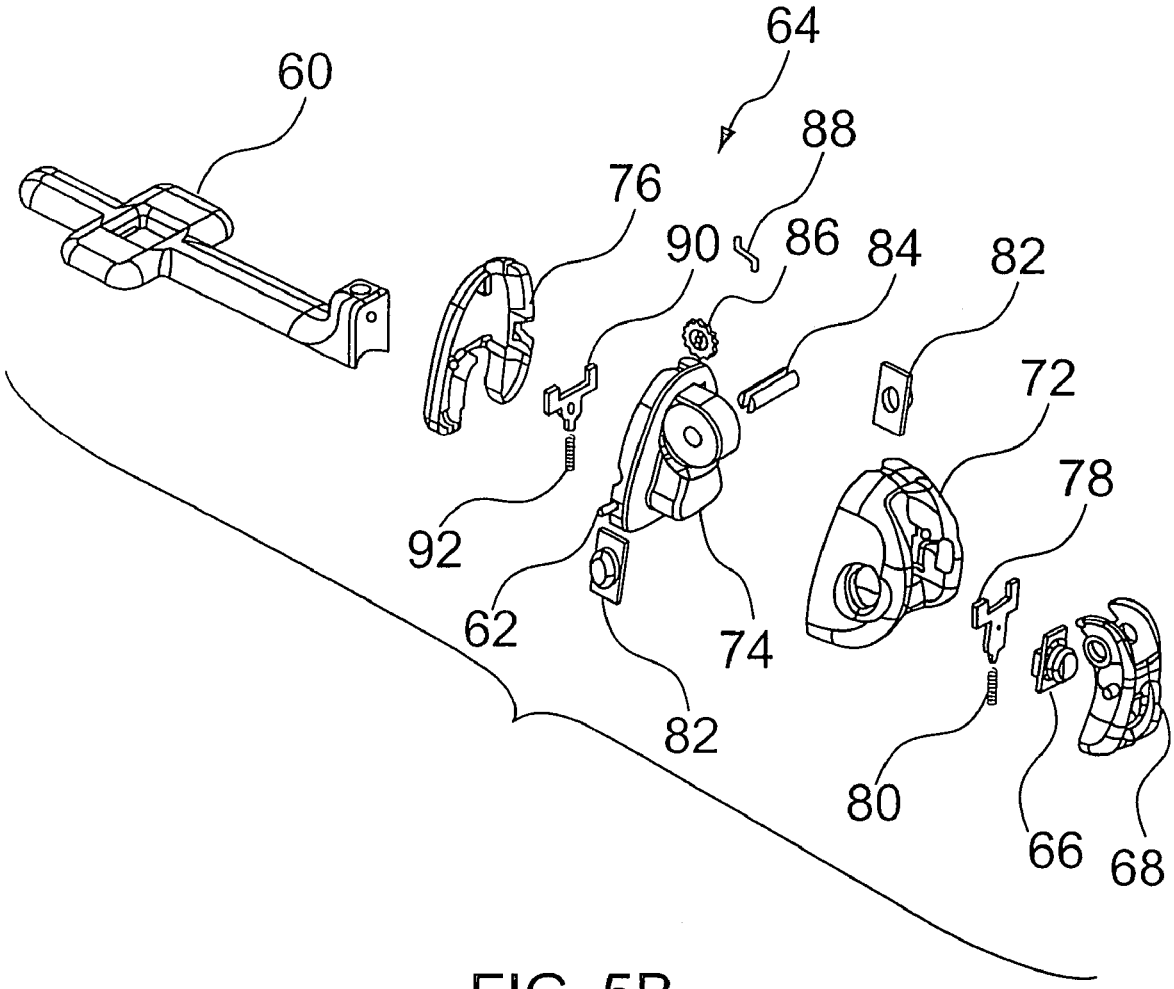
FIG. 5B is an exploded view of the second exemplary adjustment mechanism of the present invention.

Alternatively, a more complicated mechanism can be utilized, such as the one shown in FIGS. 5A and 5B. The mechanism 56 includes a foot 60 as a base. The mechanism 56 also includes a strap tensioner 62 in communication with the connecting material 6, which provides releasable attachment of the mechanism 56 with the connection material. The strap tensioner 62 can be a clamp or other element that grips the connecting material 6 by way of friction or grasping implements. The mechanism 56 can further include a ratchet device 64 in communication with the strap tensioner 62, to control travel of the connecting material 6 with respect to the mechanism 56. That is, the ratchet device 64 controls the direction and extent of travel of the gripped connecting material 6, in a manner known to those of skill in the art. A trigger device 66 with a handle 68 is also included, to actuate the ratchet device 64 to initiate travel of the connecting material 6.

The mechanism 56 includes a housing 70, including a shroud 72, shroud back 74, and back mounting plate 76, attached to the foot 60 and to the end panel. The shroud 72 houses a handle trigger 78 and trigger spring 80 for the trigger device 66, as well as a pair of housing triggers 82. The shroud back 74 provides a base for the strap tensioner 62 and elements of the ratchet device 64, such as the spindle 84, take up gear 86, and spindle pin 88. The shroud back 74 and back mounting plate 76 together house the shroud trigger 90 and trigger spring 92.

As an alternative, the connection pieces 10 can include a mounting plate 94 that is removably attached to one of the end panels 4, as shown in FIG. 2, such as by attachment to the end pieces of the frame 14. The mounting plate 94 can include apertures 96 through which the connecting material 6 passes, and a mechanism 98, such as a buckle or clamp, for fixing the connecting material 6 in place with respect to the mounting plate 94. The height of the mounting plate 94 with respect to the frame 14 can be fixed by selecting the point at which the mounting plate 94 is attached to the end pieces. Alternatively, the mounting plate 94 can include a mechanism for adjusting the position at which the mounting plate 94 is removably attached to the end panel.

Figure 8:
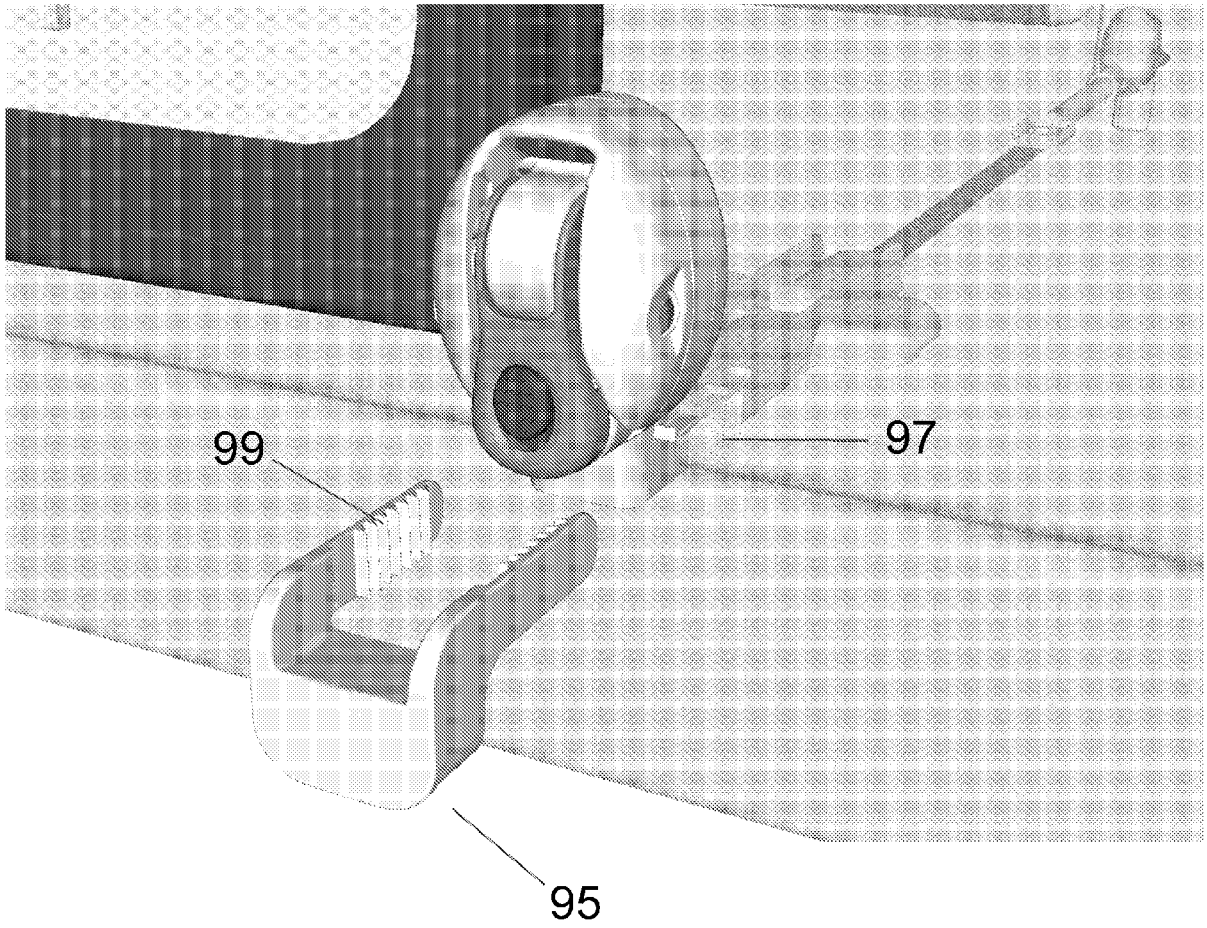
FIG. 8 shows an exemplary extension of the connection device.
Figure 9:
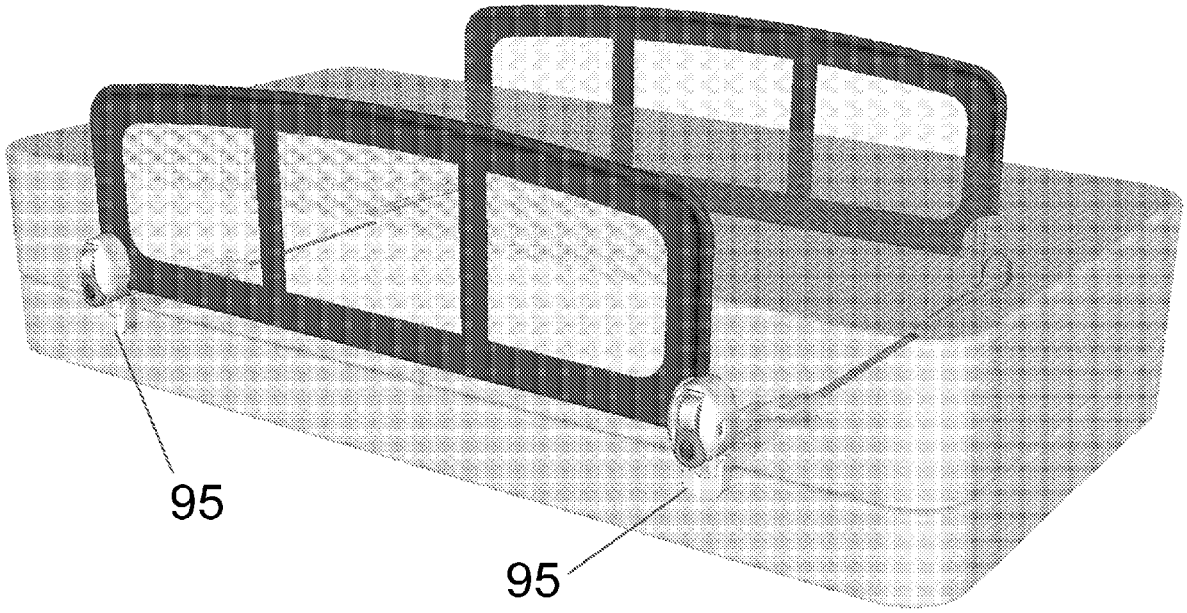
FIG. 9 shows an exemplary embodiment of the bed guard assembly with connection device extensions, in place below a mattress.

As shown in FIGS. 8 and 9, extensions 95 can be coupled to the connection pieces 10 such that when the bed guard assembly is in place below a mattress, the extensions 95 overhang the box spring below to more firmly hold the bed guard assembly in place. These extensions 95 can be coupled to any one or more of the connection pieces 10, and can be used with bed guard assemblies having two end panels, as described above, or with those having only one end panel, as described below. Further, the extensions 95 can be used as part of a bed guard assembly that is attached to a futon bed or other bed that does not use a traditional mattress and box spring set-up. In such a case, the extension can be adjusted such that it is flush with the futon or bed frame below the mattress.

As shown in FIG. 8, an exemplary extension 95 includes a transverse portion and a downward extension. The transverse portion couples to the connection piece 10 and is adjusted with respect to the connection piece, preferably such that the downward extension is flush against the box spring. The coupling mechanism between the connection piece and the extension can be adapted to facilitate the adjustment. For example, threaded pins on the extension can mate with grooves in the connection pieces in order to adjust the relative position of the extensions, and then the threaded pins can be tightened to secure the extensions in place. Alternatively, as shown in FIG. 8, at least one inside surface of the transverse portion of the extension 95 can include a ratcheted surface 99. The connection piece 10 can include a corresponding ratcheted surface 97 that mates with the ratcheted surface 99 of the extension 95. As the transverse portion of the extension 95 is slid over the ratcheted surface 97 of the connection piece 10, the mating teeth resist uncoupling movement of the extension, holding the extension firmly in place. Thus, the extension can be adjusted until it is flush against the box spring, or when it is in any other desired position. The transverse portions of the extension 95 are preferably sufficiently pliable to allow a spreading force to be applied such that the extensions 95 can be removed. Alternatively, the connection pieces 10 can include a release that moves the ratcheted surface 97 inward, allowing the extension 95 to be removed.

Alternative embodiments are contemplated in which the bed guard assembly has only one end panel. In this case, the other end panel will be replaced by an implement that grasps the mattress on that side, or that otherwise provides a stationary base that allows the connecting material to be pulled taut at the end panel on the opposing side. Such a base can be provided by the extensions 95 described above, or by any other type of device that provides resistance to removal of the connecting material. In this one-sided embodiment, it is contemplated that the connecting material can be rigid, rather than flexible.

We claim:

1. A bed guard assembly, comprising:

a plurality of end panels;

a spanner adapted for placement against one of a top surface and a bottom surface of a mattress;

connectors that are adapted to connect the spanner to the end panels such that at least one end panel of the plurality of end panels opposes another end panel of the plurality of end panels across the mattress when the spanner is disposed against the surface of the mattress; and an extension that is removably attachable to one of the connectors to extend from said one of the connectors at a substantially right angle with respect to the spanner, downward from the spanner and parallel to the plane of the respective end panel.

2. The bed guard assembly of claim 1, wherein the plurality of end panels is two ends panels.

3. The bed guard assembly of claim 2, wherein the spanner is two spanners.

4. The bed guard assembly of claim 3, wherein each said end panel has two connectors associated therewith, wherein each said spanner is connected to a corresponding opposing connector on each said end panel.

5. The bed guard assembly of claim 1, wherein the spanner includes flexible connecting material.

6. The bed guard assembly of claim 5, wherein the flexible connecting material includes strips of webbing.

7. The bed guard assembly of claim 5, wherein each of the connectors includes a mechanism for reducing an amount of slack of flexible connecting material disposed between the end panels when the flexible connecting material is disposed against the mattress and the end panels oppose each other across the mattress.

8. The bed guard assembly of claim 7, wherein the mechanism includes a strap tensioner in communication with the flexible connecting material, which provides releasable attachment of the mechanism with the flexible connection material, and a ratchet device in communication with the strap tensioner, which controls travel of the flexible connecting material with respect to the mechanism.

9. The bed guard assembly of claim 1, wherein the spanner is a rigid member.

10. The bed guard assembly of claim 1, wherein the spanner includes a rigid member.

11. The bed guard assembly of claim 1, wherein the extension extends downward from one of the connectors.

12. The bed guard assembly of claim 11, wherein the extension is adapted to engage a side surface of the mattress.

13. The bed guard assembly of claim 11, wherein the extension is adapted to engage a side surface of a box spring on which the mattress is to be disposed.

14. The bed guard assembly of claim 11, wherein the extension is adapted to engage a frame on which the mattress is to be disposed.

15. The bed guard assembly of claim 1, wherein the extension extends upward from one of the connectors.

16. The bed guard assembly of claim 15, wherein the extension is adapted to engage a side surface of the mattress.

17. The bed guard assembly of claim 1, wherein said one of the connectors includes a first ratcheted surface, and the extension includes an attachment portion and an extension portion, wherein the attachment portion includes a second ratcheted surface that engages the first ratcheted surface to removably attach the extension to said one of the connectors.

18. The bed guard assembly of claim 17, wherein engagement of the first and second ratcheted surfaces can be adjusted to secure a distance between said one of the connectors and the extension portion of the extension.

19. The bed guard assembly of claim 17, wherein the attachment portion is biased such that the first and second ratcheted surfaces engage to hold the extension in place with respect to said one of the connectors.

20. The bed guard assembly of claim 19, wherein the attachment portion is flexible such that the bias can be overcome so that the extension can be removed from said one of the connectors.

21. The bed guard assembly of claim 1, wherein the extension is a plurality of extensions that corresponds in number to a number of the connectors, such that each said extension is removably attached to a respective one of the connectors.

22. The bed guard assembly of claim 1, wherein at least one of the end panels includes a rigid outer frame made from removably connected rigid tubes.

23. The bed guard assembly of claim 1, wherein at least one of the end panels includes a rigid outer frame including substantially parallel opposing top and bottom portions connected to substantially parallel opposing side portions.

24. The bed guard assembly of claim 1, wherein at least one of the end panels includes a rigid outer frame including a top portion and first and second side portions, and at least one stabilizer that extends toward another end panel at a substantially right angle to a plane defined by the top portion and the first and second side portions.

25. The bed guard assembly of claim 1, wherein at least one of the end panels includes a rigid outer frame including a number of segments that are removably attached to each other.

26. The bed guard assembly of claim 1, wherein at least one of the end panels includes a rigid outer frame and a fabric portion framed by the rigid outer frame.

27. The bed guard assembly of claim 1, wherein the connectors are rigid structures, and each said connector is removably attached to one of the end panels and forms a substantially right angle with the respective attached end panel.

28. The bed guard assembly of claim 1, wherein each said connector includes a first end connected to the spanner, a second end connected to one of the end panels, and an angled joint between the first and second ends.

29. The bed guard assembly of claim 28, wherein the first end is removably attached to the spanner and the second end is removably attached to said one of the end panels.

30. The bed guard assembly of claim 1, wherein at least one of the end panels includes a rigid outer frame and a substantially horizontal rigid segment spanning an interior of the outer frame.

31. The bed guard assembly of claim 30, wherein the rigid outer frame includes substantially parallel opposing top and bottom portions connected to substantially parallel opposing side portions.

32. The bed guard assembly of claim 31, wherein the substantially horizontal rigid segment is coupled to the substantially parallel opposing side portions.

33. The bed guard assembly of claim 32, wherein the assembly further comprises fasteners that fix a position of the substantially horizontal rigid segment with respect to the substantially parallel opposing side portions.

34. The bed guard assembly of claim 32, wherein the assembly further comprises a plurality of fasteners, selected ones of which fix the substantially horizontal rigid segment at a selected position with respect to the substantially parallel opposing side portions, corresponding to the selected ones of the fasteners.

35. The bed guard assembly of claim 32, wherein the assembly further comprises fasteners coupled to the substantially parallel opposing side portions.

36. The bed guard assembly of claim 35, wherein the substantially horizontal rigid segment includes apertures that mate with corresponding ones of the fasteners to fix a position of the substantially horizontal rigid segment with respect to the substantially parallel opposing side portions.

37. The bed guard assembly of claim 32, wherein the substantially horizontal rigid segment includes a tubular horizontal portion having first and second end portions that couple with the substantially parallel opposing side portions.

38. The bed guard assembly of claim 37, wherein the tubular horizontal portion includes a plurality of slidably attached tubular segments.

39. The bed guard assembly of claim 37, wherein the first and second end portions are substantially vertically-oriented tubes that slide over the respective substantially parallel opposing side portions.

40. The bed guard assembly of claim 37, wherein the assembly further comprises fasteners coupled to the substantially parallel opposing side portions.

41. The bed guard assembly of claim 40, wherein the first and second end portions include apertures that communicate with the fasteners to fix a position of the substantially horizontal rigid segment with respect to the substantially parallel opposing side portions.

42. The bed guard assembly of claim 40, wherein the first and second end portions include a plurality of apertures, including selected ones that communicate with the fasteners to fix the substantially horizontal rigid segment at a position with respect to the substantially parallel opposing side portions corresponding to the selected ones of the plurality of apertures.

43. The bed guard assembly of claim 31, further comprising:

first fastener portions coupled to the substantially parallel opposing side portions; and second fastener portions, coupled to the substantially horizontal rigid segment, which mate with corresponding ones of the first fastener portions to fix a position of the substantially horizontal rigid segment with respect to the substantially parallel opposing side portions.

44. The bed guard assembly of claim 30, wherein at least one of the end panels includes a fabric portion framed by the rigid outer frame.

45. A bed guard assembly, comprising:

an end panel;

a spanner adapted for placement against on of a top surface and a bottom surface of a mattress;

at least one connector adapted to connect the spanner to the end panel at a substantially right angle; and an extension that is removably attachable to said at least one connector to extend from said at least one connector at a substantially right angle with respect to the spanner, downward from the spanner and parallel to the plane of the respective end panel.

46. The bed guard assembly of claim 45, wherein the spanner includes flexible connecting material;

the assembly further comprising at least one base element coupled to the flexible connecting material such that the end panel opposes said at least one base element across the mattress when the flexible connecting material is disposed against the mattress.

47. The bed guard assembly of claim 46, wherein the flexible connecting material includes strips of webbing.

48. The bed guard assembly of claim 46, wherein said at least one connector includes a mechanism for reducing an amount of slack of flexible connecting material disposed between the end panel and the base element when the flexible connecting material is disposed against the mattress and the end panel and the base element oppose each other across the mattress.

49. The bed guard assembly of claim 48, wherein the mechanism includes a strap tensioner in communication with the flexible connecting material, which provides releasable attachment of the mechanism with the flexible connection material, and a ratchet device in communication with the strap tensioner, which controls travel of the flexible connecting material with respect to the mechanism.

50. The bed guard assembly of claim 45, wherein the spanner is a rigid member.

51. The bed guard assembly of claim 45, wherein the spanner includes a rigid member.

52. The bed guard assembly of claim 45, wherein the extension extends downward from said at least one connector.

53. The bed guard assembly of claim 52, wherein the extension is adapted to engage a side surface of the mattress.

54. The bed guard assembly of claim 52, wherein the extension is adapted to engage a side surface of a box spring on which the mattress is to be disposed.

55. The bed guard assembly of claim 52, wherein the extension is adapted to engage a frame on which the mattress is to be disposed.

56. The bed guard assembly of claim 45, wherein the extension extends upward from said at least one connector.

57. The bed guard assembly of claim 56, wherein the extension is adapted to engage a side surface of the mattress.

58. The bed guard assembly of claim 45, wherein said at least one connector includes a first ratcheted surface, and the extension includes an attachment portion and an extension portion, wherein the attachment portion includes a second ratcheted surface that engages the first ratcheted surface to removably attach the extension to said at least one connector.

59. The bed guard assembly of claim 58, wherein engagement of the first and second ratcheted surfaces can be adjusted to secure a distance between said at least one connector and the extension portion of the extension.

60. The bed guard assembly of claim 58, wherein the attachment portion is biased such that the first and second ratcheted surfaces engage to hold the extension in place with respect to said at least one connector.

61. The bed guard assembly of claim 60, wherein the attachment portion is flexible such that the bias can be overcome so that the extension can be removed from said at least one connector.

62. The bed guard assembly of claim 45, wherein the at least one connector is a plurality of connectors and the extension is a plurality of extensions that corresponds in number to a number of the connectors, such that each said extension is removably attached to a respective one of the connectors.

63. The bed guard assembly of claim 45, wherein the end panel includes a rigid outer frame made from removably connected rigid tubes.

64. The bed guard assembly of claim 45, wherein the end panel includes a rigid outer frame including substantially parallel opposing top and bottom portions connected to substantially parallel opposing side portions.

65. The bed guard assembly of claim 45, wherein the end panel includes a rigid outer frame including a number of segments that are removably attached to each other.

66. The bed guard assembly of claim 45, wherein the end panel includes a rigid outer frame and a fabric portion framed by the rigid outer frame.

67. The bed guard assembly of claim 45, wherein said at least one connector is a rigid structure that is removably attached to the end panels and forms a substantially right angle with the end panel.

68. The bed guard assembly of claim 45, wherein said at least one connector includes a first end connected to the spanner, a second end connected to the end panel, and an angled joint between the first and second ends.

69. The bed guard assembly of claim 68, wherein the first end is removably attached to the spanner and the second end is removably attached to the end panel.

70. The bed guard assembly of claim 45, wherein the end panel includes a rigid outer frame and a substantially horizontal rigid segment spanning an interior of the outer frame.

71. The bed guard assembly of claim 70, wherein the rigid outer frame includes substantially parallel opposing top and bottom portions connected to substantially parallel opposing side portions.

72. The bed guard assembly of claim 71, wherein the substantially horizontal rigid segment is coupled to the substantially parallel opposing side portions.

73. The bed guard assembly of claim 72, wherein the assembly further comprises fasteners that fix a position of the substantially horizontal rigid segment with respect to the substantially parallel opposing side portions.

74. The bed guard assembly of claim 72, wherein the assembly further comprises a plurality of fasteners, selected ones of which fix the substantially horizontal rigid segment at a selected position with respect to the substantially parallel opposing side portions, corresponding to the selected ones of the fasteners.

75. The bed guard assembly of claim 72, wherein the assembly further comprises fasteners coupled to the substantially parallel opposing side portions.

76. The bed guard assembly of claim 75, wherein the substantially horizontal rigid segment includes apertures that mate with corresponding ones of the fasteners to fix a position of the substantially horizontal rigid segment with respect to the substantially parallel opposing side portions.

77. The bed guard assembly of claim 72, wherein the substantially horizontal rigid segment includes a tubular horizontal portion having first and second end portions that couple with the substantially parallel opposing side portions.

78. The bed guard assembly of claim 77, wherein the tubular horizontal portion includes a plurality of slidably attached tubular segments.

79. The bed guard assembly of claim 77, wherein the first and second end portions are substantially vertically-oriented tubes that slide over the respective substantially parallel opposing side portions.

80. The bed guard assembly of claim 77, wherein the assembly further comprises fasteners coupled to the substantially parallel opposing side portions.

81. The bed guard assembly of claim 80, wherein the first and second end portions include apertures that communicate with the fasteners to fix a position of the substantially horizontal rigid segment with respect to the substantially parallel opposing side portions.

82. The bed guard assembly of claim 80, wherein the first and second end portions include a plurality of apertures, including selected ones that communicate with the fasteners to fix the substantially horizontal rigid segment at a position with respect to the substantially parallel opposing side portions corresponding to the selected ones of the plurality of apertures.

83. The bed guard assembly of claim 71, further comprising:

first fastener portions coupled to the substantially parallel opposing side portions; and second fastener portions, coupled to the substantially horizontal rigid segment, which mate with corresponding ones of the first fastener portions to fix a position of the substantially horizontal rigid segment with respect to the substantially parallel opposing side portions.

84. The bed guard assembly of claim 70, wherein the end panel includes a fabric portion framed by the rigid outer frame.

* * * * *